United States Patent [19]

Rodert et al.

[11] Patent Number: 4,993,504

[45] Date of Patent: Feb. 19, 1991

[54] DEVICE FOR EFFICIENT ENERGY TRANSFER AND DAMPING OF IMPACT DRILLING MACHINES

[75] Inventors: Jörgen A. R. Rodert, Saltsjö-Boo; Kurt H. Andersson, Tyresö, both of Sweden

[73] Assignee: Atlas Copco MCT AB, Nacka, Sweden

[21] Appl. No.: 476,985

[22] Filed: Feb. 8, 1990

[30] Foreign Application Priority Data

Feb. 21, 1989 [SE] Sweden ..... 8900571

[51] Int. Cl.[5] ..... E21B 1/02; E21B 6/00

[52] U.S. Cl. ..... 175/135; 173/105; 173/131; 173/139; 175/162; 175/173; 175/189

[58] Field of Search ..... 175/135, 173, 171, 113, 175/162, 189; 173/104, 105, 139, 131, 133

[56] References Cited

U.S. PATENT DOCUMENTS

| | | | |
|---|---|---|---|
| 3,356,166 | 12/1967 | Diachenko | 173/139 |
| 4,068,727 | 1/1978 | Andersson et al. | 173/139 X |
| 4,314,613 | 2/1982 | Kuhn | 173/131 |
| 4,387,775 | 6/1983 | Adolfsson et al. | 173/131 X |
| 4,593,768 | 6/1986 | Eklof | 173/131 X |
| 4,871,035 | 10/1989 | Ekwall | 173/139 |

FOREIGN PATENT DOCUMENTS

| | | | |
|---|---|---|---|
| 112810 | 7/1984 | European Pat. Off. | 175/135 |
| 2738956 | 3/1979 | Fed. Rep. of Germany | 173/105 |
| 2802874 | 7/1979 | Fed. Rep. of Germany | 173/105 |
| 2596681 | 10/1987 | France | 173/139 |
| 1113532 | 9/1984 | U.S.S.R. | 173/105 |

*Primary Examiner*—Hoang C. Dang

*Attorney, Agent, or Firm*—Erie Y. Munson; Mark P. Stone

[57] ABSTRACT

Device in impact machines. The device comprises a first chamber (5) which is connected to an accumlator (6) and the pressure of which is used to hold together a set of rods (2) forming part of the drill tool. Furthermore there is a second chamber (7) to damp the recoil from the set of rods.

2 Claims, 1 Drawing Sheet

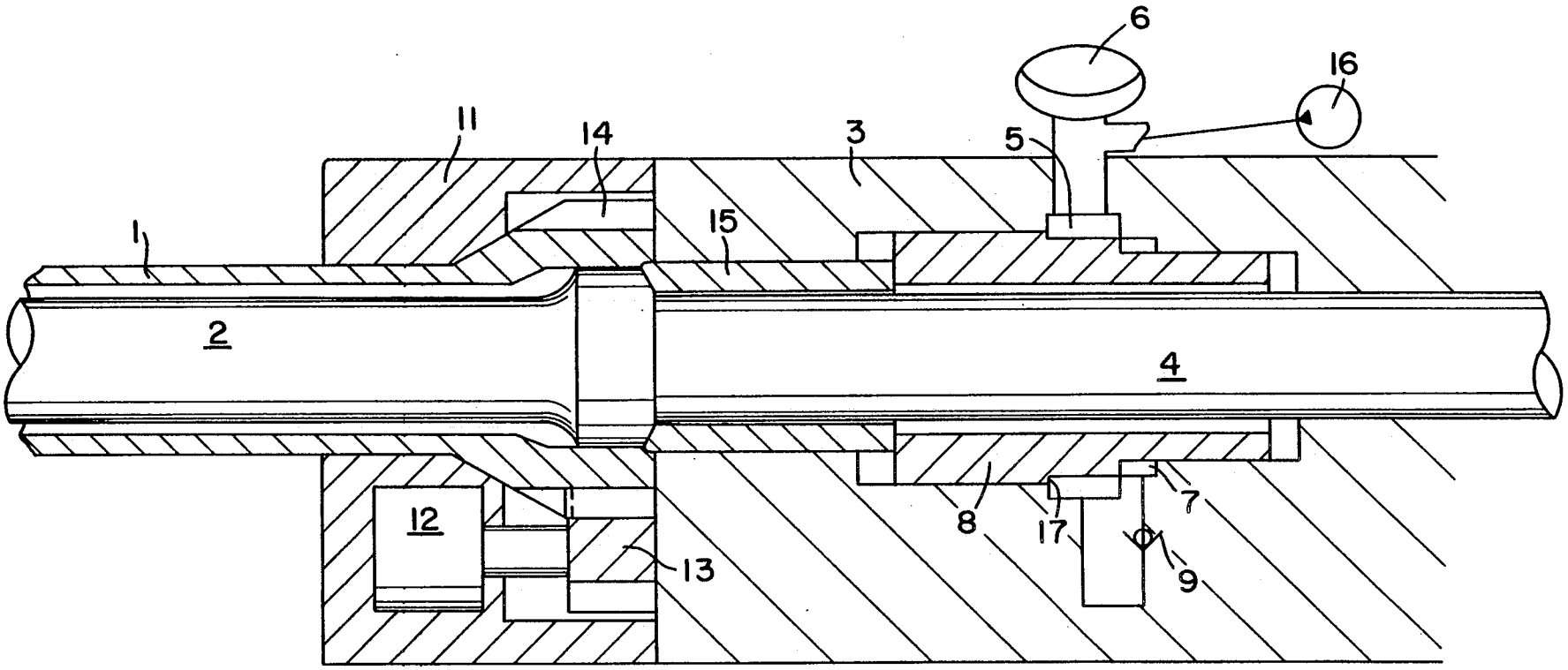
16
6
5
3
15
14
11
1
2
4
7
9
17
8
13
12

DEVICE FOR EFFICIENT ENERGY TRANSFER AND DAMPING OF IMPACT DRILLING MACHINES

The present invention relates to a device in impact machines for drilling. preferably in rock, by means of a drill string comprising a set of tubes and a set of rods arranged in the set of tubes.

When drilling with drill strings of the above mentioned kind the problem arises that the rods forming part of the set of rods not always abut against each other when the hammer piston hits the rearmost part of the set of rods This results therein that the energy of the hammer piston only partly is transferred to the drill bit at the other end of the drill string.

The present invention, which is defined in the subsequent claims aims at achieving a device of the kind mentioned above where the rods forming part of the set of rods abut against each other when the hammer piston hits The invention furthermore aims at achieving an efficient damping of the recoil without jeopardizing the abutment between the rods of the set of rods This problem is substantially larger with this type of drill string than with a drill string where the rods are connected with each other since the energy of the recoil from the rock substantially entirely is transferred to the rearmost part in the set of rods. This part, therefore obtains a large kinetic energy and will thus move far. If this occurs it will take a long time before the rods in the set of rods abut against each other again This means that drilling can only occur with low frequency if the rods are to be held against each other during the drilling. With the present invention it is possible to hold the rods against each other also at high frequencies.

An embodiment of the invention is described below with reference to the accompanying drawing which schematically shows a section through a device according to the invention.

The device shown in the drawing comprises a machine housing 3 on which a front part 11 is secured. The drilling device comprises a drill string comprising a set of tubes in the drawing represented by the drill sleeve 1 which forms the rearmost part, and a set of rods 2, which in the drawing is represented by an adapter 2 arranged in the machine. A not shown drill bit is arranged at the front end of the drill string. The drill bit is rotated by means of the set of tubes which in its turn is rotated by a rotary motor 12 via a toothed wheel 13 which gears with teeth 14 on the drill sleeve 1. A hammer piston 4 is movable to-and-fro in the machine housing 3 in the usual way. The hammer piston transfers its energy to the adapter 2 in the set of rods. This energy is then transferred from rod to rod in the set of rods and from the set of rods to the drill bit. A sleeve 15 and a piston 8 are slidably arranged in the machine housing 3. These transfer to the adapter 2 a force determined by the pressure in a first chamber 5. This pressure acts on a forwardly directed surface 17. This force is used during drilling to hold the rods of the set of rods together. Chamber 5 is connected to an accumulator 6 which is supplied with pressure liquid from a pressure liquid source 16. Piston 8 is with close fit movable into a second chamber 7. This means that the recoil from the rock is efficiently damped because liquid is pressed out through the narrow slot between piston 8 and the machine housing 3 In order to avoid cavitation when piston 8 moves out of chamber 7 a check valve 9 is arranged between the first and second chambers and directed such that liquid flow is allowed from first chamber 5 to second chamber 7.

What is claimed is:

1. A device in impact machines for drilling by means of a drill string, said device comprising a set of tubes (1) for transferring rotation to a drill bit and a set of separate rods (2) arranged centrally in the set of tubes for transferring impact energy from a hammer piston (4) movable to and fro in a machine housing (3) to said drill bit, characterized in that said device comprises a first chamber (5) and a second chamber (7) defined within said machine housing (3), a piston movable within said machine housing (3), said piston having a surface in fluid communication with said first chamber (5) such that liquid pressure within said first chamber determines a forwardly directed force transferred by said piston, and an accumulator (6) coupled in fluid communication to said first chamber, said piston being movable into said second chamber in closely fitting relationship therein to entrap a liquid volume for damping a recoil from said set of rods causing said piston to move in a rearwardly direction.

2. A device according to claim 1 characterized in that a check valve (9) is disposed between said first (5) and said second (7) chambers to direct fluid flow from said first chamber to said second chamber.

* * * * *